US007437830B1

(12) United States Patent
Kulavic

(10) Patent No.: US 7,437,830 B1
(45) Date of Patent: Oct. 21, 2008

(54) STUD MARKER

(76) Inventor: Anthony C. Kulavic, 5505 Reserves Blvd., Springfield, IL (US) 62711

( * ) Notice: Subject to any disclaimer, the term of this patent is extended or adjusted under 35 U.S.C. 154(b) by 41 days.

(21) Appl. No.: 11/716,495

(22) Filed: Mar. 8, 2007

Related U.S. Application Data

(60) Provisional application No. 60/780,276, filed on Mar. 8, 2006.

(51) Int. Cl.
*B25H 7/04* (2006.01)

(52) U.S. Cl. ..... 33/670; 33/666; 33/562

(58) Field of Classification Search ..... 33/666, 33/670, 672, 673, 674, 675, 676, 677, 678, 33/574, 562, 563
See application file for complete search history.

(56) References Cited

U.S. PATENT DOCUMENTS 2,567,586 A * 9/1951 Werder ..... 33/562
3,842,510 A 10/1974 Elliot ..... 33/180 R
4,212,108 A * 7/1980 Jackson ..... 33/645
4,363,173 A * 12/1982 Caldera ..... 33/666
4,365,418 A * 12/1982 Hoyss et al. ..... 33/666
4,625,415 A * 12/1986 Diamontis ..... 33/562
4,893,970 A * 1/1990 Becraft ..... 33/574
4,993,168 A * 2/1991 Acuna ..... 33/666
5,129,297 A 7/1992 Bussi ..... 83/30
5,222,303 A 6/1993 Jardine ..... 33/528
5,615,490 A 4/1997 Burchell ..... 33/528
5,960,554 A * 10/1999 Kamykowski ..... 33/562
6,473,982 B1 * 11/2002 Schimes ..... 33/562
6,820,342 B2 * 11/2004 Ramsthaler ..... 33/809
7,040,546 B2 * 5/2006 Horan et al. ..... 239/DIG. 14

* cited by examiner

*Primary Examiner*—G. Bradley Bennett
(74) *Attorney, Agent, or Firm*—Philip L. Bateman

(57) ABSTRACT

A stud marker is used for marking the location of a vertical stud in a framed wall having a sole plate and a plurality of vertical studs on the floor directly in front of the stud. The stud marker contains a paint wand attached to a marking guide. The marking guide has a flat plate with an opening, a vertical wall, and at least one projecting member for centering the opening in front of a stud.

10 Claims, 2 Drawing Sheets

STUD MARKER

CROSS-REFERENCE TO RELATED APPLICATION

This application claims the benefit of U.S. Provisional Application Ser. No. 60/780,276, Mar. 8, 2006.

FIELD OF THE INVENTION

This invention relates to building construction. More particularly, this invention relates to geometrical instruments for constructing frame walls.

BACKGROUND OF THE INVENTION

Buildings are commonly constructed with frame walls. A frame wall consists of a horizontal sole plate that is attached to the floor, a horizontal top plate that is attached to overhead joists or rafters, and a plurality of spaced apart vertical studs extending between the foot plate and the head plate. The plates and studs are generally made of either two-by-four boards or metal framing members having similar dimensions. A nominal two-by-four board is actually about one and three-fourths inches in depth and about three and one-half inches in width.

After the frame wall is built, a wide variety of multi-component systems are installed, including electrical, plumbing, telephone, television, internet, and the like. Many of the components of these systems are mounted to the studs. These stud-mounted components include electrical outlets and switches, plumbing fixtures, telephone jacks, cable television jacks, internet jacks, intercom speakers, vacuum system ports, and the like. The walls are then covered with drywall, paneling, or other sheet material. It is important to know the location of the studs for attaching the wall covering material and for later attaching shelving or other items that require a supporting member. It is also important to know the location of the system components so that holes can be cut in the wall covering material to expose them.

Some construction workers make marks on the floor with pencils, pens, or paint to indicate the location of the studs and other components. For example, paint wands comprising an elongated pole with a receptacle for holding an upside-down can of spray paint have been used for this purpose. Unfortunately, the marks made in this manner are not precise. A variety of devices have been disclosed to precisely locate electrical boxes, including the devices disclosed in Elliot, U.S. Pat. No. 3,842,510, Oct. 22, 1974; Bussi, U.S. Pat. No. 5,129,297, Jul. 14, 1992; Jardine, U.S. Pat. No. 5,222,303, Jun. 29, 1993; and Burchell, U.S. Pat. No. 5,615,490, Apr. 1, 1997. Unfortunately, these devices require knowing the location of the stud.

Accordingly, there is a demand for a stud marker that precisely marks the locations of studs and the location of other components attached to the studs.

SUMMARY OF THE INVENTION

The general object of this invention is to provide an improved stud marker. A more particular object is to provide a stud marker that precisely marks the location of a stud on the floor directly in front of the stud.

I have invented an improved stud marker for marking the location of a vertical stud in a framed wall having a sole plate and a plurality of studs on the floor directly in front of the stud. The stud marker comprises: (a) a paint wand comprising: (i) an elongated pole having proximate and distal ends; (ii) a handle and trigger at the proximate end of the pole; (iii) a receptacle near the distal end of the pole for holding a can of spray paint with the nozzle pointing downwardly; and (iv) a trigger-activated mechanism for discharging paint from a can held in the receptacle; and (b) a marking guide comprising: (i) a flat plate having proximate and distal ends, the plate adapted for resting upon a floor, the plate having an opening; (ii) a vertical wall extending upwardly from the distal end of the plate, the wall having an inward surface facing the proximate end of the plate and an outward surface; (iii) at least one projecting member extending from the outward surface of the wall, the member located vertically at a height above the plate of at least about one and three-fourths inches so that it extends above a sole plate when the marking guide rests upon a floor, the member located horizontally so that the plate opening is centered in front of a stud when the member is in contact with a side of a stud; and (iv) a means for holding the distal end of the pole of the paint wand in a position so that paint discharged from a can is directed toward the opening in the plate.

The stud marker of this invention quickly, easily, and precisely marks the location of a stud on the floor directly in front of the stud.

DETAILED DESCRIPTION OF THE INVENTION

Figure 1:
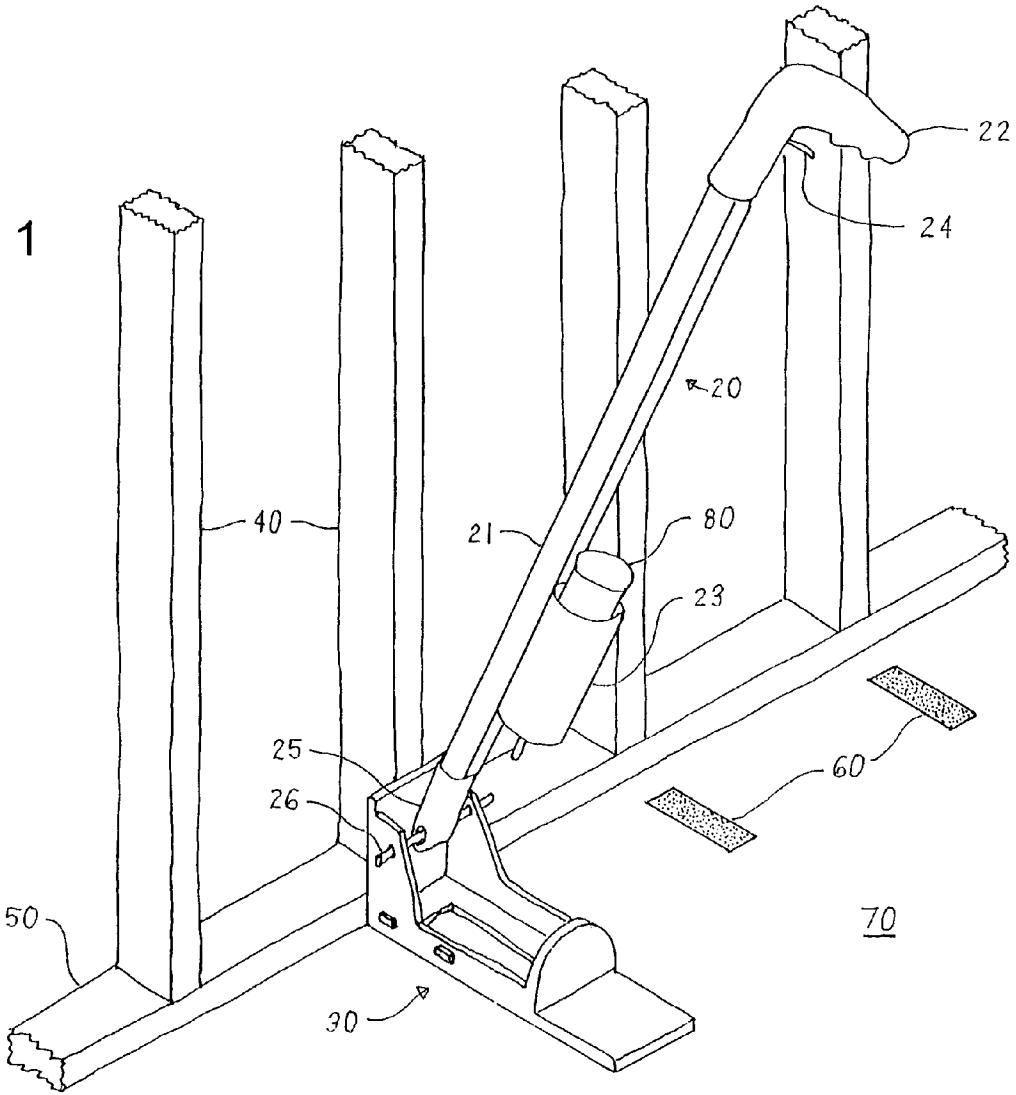
FIG. 1 is a perspective view of a preferred embodiment of the stud marker of this invention in use marking the location of studs in a framed wall.

This invention is best understood by reference to the drawings. Referring to FIG. 1, the stud marker 10 of this invention comprises a paint wand 20 and a marking guide 30. The stud marker is used to mark the location of a stud 40 in a framed wall comprising a sole plate 50 and a plurality of studs. The location markings 60 are made in paint on the floor 70 directly in front of the studs.

The paint wand is conventional. Paint wands are widely used for applying paint to a floor or the ground while standing. The paint wand contains an elongated pole 21 having a length of about two to four feet. The paint wand is held by a handle 22 at the proximate end. A cup receptacle 23 is mounted on the pole near the distal end. The cup receptacle holds a can of spray paint 80 in the upside down position with the nozzle pointing downward. A trigger 24 at the handle operates a mechanism that moves the nozzle of the spray paint can to discharge paint in the downward direction. Paint wands typically contain a fitting 25 at the distal end. The fitting typically contains opposed holes to accept an axle with wheels so that the paint wand can be rolled across the surface. For use in this invention, the fitting is used to attach the marking guide with a pin 26.

Figure 2:
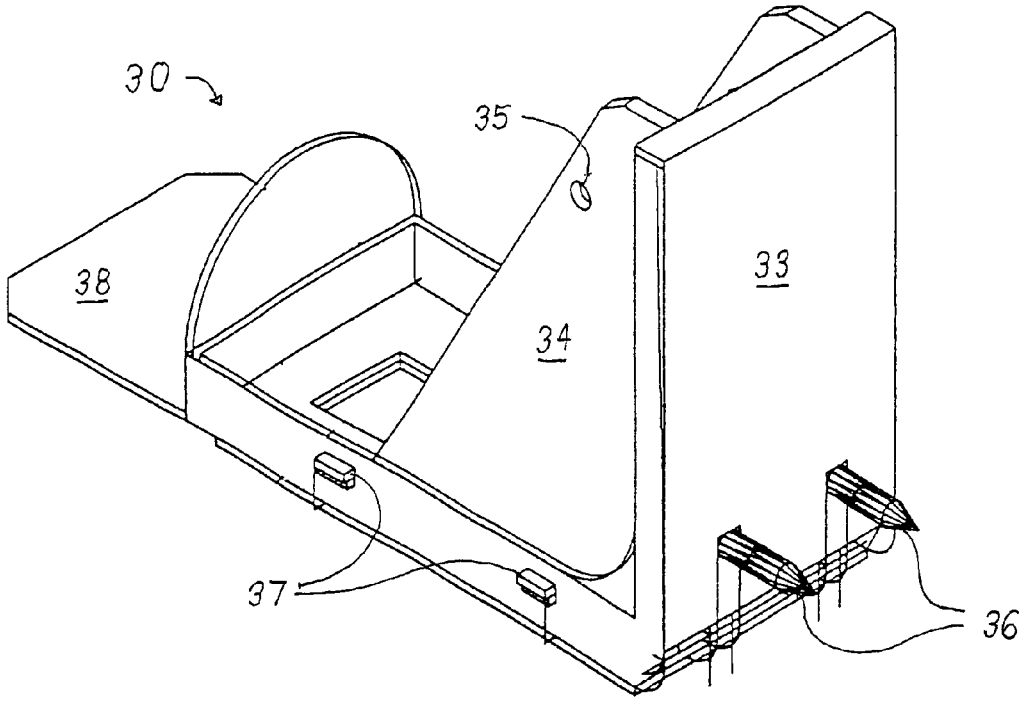
FIG. 2 is a perspective view of the marking guide of the stud marker.
Figure 3:
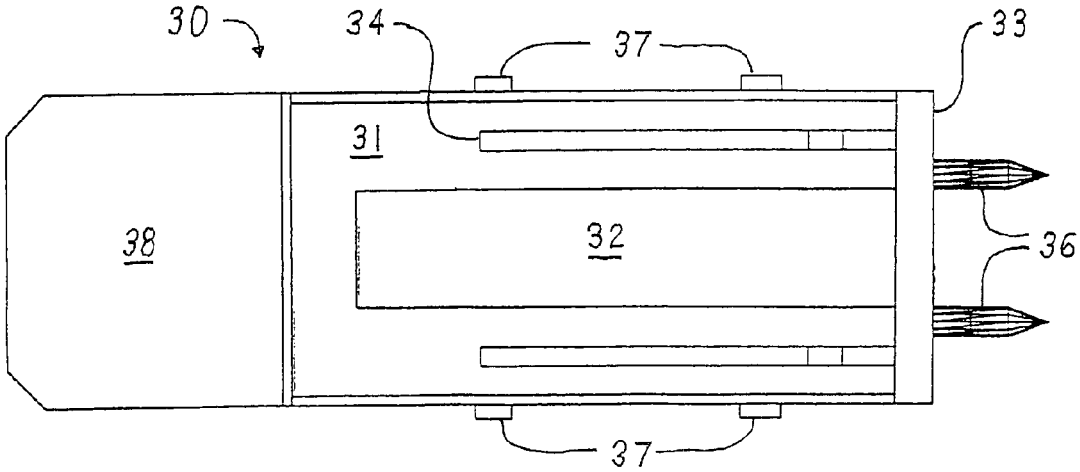
FIG. 3 is a top plan view thereof.

The attached marking guide is located below the can of paint so that discharged paint is sprayed toward the guide. Referring now also to FIGS. 2 and 3, the guide contains a flat plate 31 that rests upon the floor. The plate has an opening (or void) 32 that allows some of the paint to spray onto the floor. The size and shape of the opening thus acts as a stencil and determines the pattern of paint created on the floor. A vertical wall 33 extends upwardly from the distal end of the plate (the end nearer the wall and opposite the user). Side walls 34 contain holes 35 for accepting the pin that attaches the marking guide to the paint wand.

Two projecting members 36 extend outwardly from the outward surface of the wall. The projecting members are located at least one and three-fourths inches, preferably at least about two inches, above the flat plate so that they extend above, and do not contact, the sole plate. The projecting members are preferably located about two and one-half to four inches above the flat plate. The two projecting members are spaced apart horizontally by about one and three-fourths inches to two inches so that a stud fits between them with little play. The projecting members preferably pivot downward into recesses in the vertical wall so that the stud guide can be used with only one or the other. While two projecting members are preferred, a single projecting member is suitable for most uses.

The marking guide preferably contains a means for mounting stencils. In the preferred embodiment, the mounting means are two brackets 37 on each side. As explained below, stencils are used when a particular letter, number, or symbol is desired in the painted marking. The marking guide also preferably contains a foot plate 38 which extends from the flat plate and enables the user to secure the marking guide when paint is being sprayed.

The marking guide is made of a durable material such as plastic or metal. Suitable plastics include polyvinylchloride (PVC), polyethylene, polystyrene, and the like. Suitable metals include steel, stainless steel, aluminum, and the like. The preferred material is plastic because of its relatively low cost and light weight.

As previously mentioned, the vertical wall of the marking guide is sufficiently high so that the projecting member(s) can clear the sole plate. The vertical wall is sufficiently wide to accommodate two projecting members with a space between them to accept a stud. The other dimensions of the marking guide are a matter of choice. The width of the marking guide is generally about three to six inches. The depth of the marking guide is generally about four to eight inches. The size and shape of the opening in the flat plate is also a matter of choice. In the preferred embodiment shown in the drawings, the opening is a rectangle having a width of one and three-fourths inches (to exactly correspond with the stud) and a depth of about four to six inches.

The use of the stud marker of this invention can now be considered. The stud marker is used after a wall has been framed, but before it has been covered with a wall material, as shown in FIG. 1. The stud marker is loaded with a can of spray paint and the user simply walks around the room, places the stud marker in position in front of a stud using the projecting member(s) for precise alignment, and then pulls the trigger on the handle to spray paint through the opening onto the floor. In cases where the wall contains two studs side-by-side for additional load bearing, the location of both of the studs can be marked (if the stud marker contains two pivoting projecting members) by depressing one of the projecting members, marking the location of one stud, and then reversing the position of the projecting members and marking the location of the other stud.

After the location of the studs has been performed, the location of system components can be performed. To differentiate the markings, a can of paint of a different color can be used or a stencil can be placed over the opening in the flat plate.

I claim:

1. A stud marker for marking the location of a vertical stud in a framed wall having a sole plate and a plurality of studs on the floor directly in front of the stud, the stud marker comprising:

(a) a paint wand comprising: (i) an elongated pole having proximate and distal ends; (ii) a handle and trigger at the proximate end of the pole; (iii) a receptacle near the distal end of the pole for holding a can of spray paint with the nozzle pointing downwardly; and (iv) a trigger-activated mechanism for discharging paint from a can held in the receptacle; and (b) a marking guide comprising: (i) a flat plate having proximate and distal ends, the plate adapted for resting upon a floor, the plate having an opening; (ii) a vertical wall extending upwardly from the distal end of the plate, the wall having an inward surface facing the proximate end of the plate and an outward surface; (iii) at least one projecting member extending from the outward surface of the wall, the member located vertically at a height above the plate of at least about one and three-fourths inches so that it extends above a sole plate when the marking guide rests upon a floor, the member located horizontally so that the plate opening is centered in front of a stud when the member is in contact with a side of a stud; and (iv) a means for holding the distal end of the pole of the paint wand in a position so that paint discharged from a can is directed toward the opening in the plate.

2. The stud marker of claim 1 wherein each projecting member is pivoting.

3. The stud marker of claim 2 additionally comprising a second projecting member spaced apart horizontally from the first projecting member by about one and three-fourths inches so that the projecting members form a space for receiving a stud.

4. The stud marker of claim 3 additionally comprising a means for mounting stencils across the opening in the plate.

5. The stud marker of claim 4 additionally comprising a foot plate extending from the proximate end of the flat plate.

6. A marking guide for use in combination with a paint wand to provide an apparatus for marking the location of a vertical stud in a framed wall having a sole plate and a plurality of studs on the floor directly in front of the stud, the marking guide comprising:

(a) a flat plate having proximate and distal ends, the plate adapted for resting upon a floor, the plate having an opening;

(b) a vertical wall extending upwardly from the distal end of the plate, the wall having an inward surface facing the proximate end of the plate and an outward surface;

(c) at least one projecting member extending from the outward surface of the wall, the member located vertically at a height above the plate of at least about one and three-fourths inches so that it extends above a sole plate when the marking guide rests upon a floor, the member located horizontally so that the plate opening is centered in front of a stud when the member is in contact with a side of a stud; and (d) a means for holding a paint wand in a position so that paint is directed toward the opening in the plate.

7. The marking guide of claim 6 wherein each projecting member is pivoting.

8. The marking guide of claim 7 additionally comprising a second projecting member spaced apart horizontally from the first projecting member by about one and three-fourths inches so that the projecting members form a space for receiving a stud.

9. The marking guide of claim 8 additionally comprising a means for mounting stencils across the opening in the plate.

10. The marking guide of claim 9 additionally comprising a foot plate extending from the proximate end of the flat plate.

* * * * *